United States Patent [19]

Kinoshita et al.

[11] 4,397,451

[45] Aug. 9, 1983

[54] FURNACE FOR THE HEAT TREATMENT OF SCALE-COVERED STEEL

[75] Inventors: Keizo Kinoshita, Takatsuki; Koji Murakami, Settsu; Hitoshi Ohta, Sakai, all of Japan

[73] Assignees: Chugai Ro Kogyo Co., Ltd.; O & K Company Ltd., both of Japan

[21] Appl. No.: 349,662

[22] Filed: Feb. 17, 1982

Related U.S. Application Data

[62] Division of Ser. No. 272,118, Jun. 10, 1981.

[51] Int. Cl.[3] ..... C21D 9/00

[52] U.S. Cl. ..... 266/252; 432/128; 432/198

[58] Field of Search ..... 266/251, 252, 257; 432/18, 19, 26, 198, 128

[56] References Cited

U.S. PATENT DOCUMENTS

| | | | |
|---|---|---|---|
| 3,182,981 | 5/1965 | Walker | 432/198 |
| 3,778,221 | 12/1973 | Bloom | 432/11 |
| 3,982,887 | 9/1976 | Kendziora et al. | 432/128 |
| 4,079,921 | 3/1978 | Iszczukiewicz | 266/252 |

*Primary Examiner*—L. Dewayne Rutledge
*Assistant Examiner*—Christopher W. Brody
*Attorney, Agent, or Firm*—Wenderoth, Lind & Ponack

[57] ABSTRACT

A scale-covered, hot-rolled steel work is heated under a reducing atmosphere and is then allowed to slowly cool while placed under the reducing atmosphere. Thereafter the work is maintained at a predetermined temperature under an oxidizing atmosphere to cause the scale to be re-oxidized. The work with the re-oxidizing scale is then allowed to stand to cool quickly, imparting fine cracks to the scales. The scales can readily be removed from the work during the subsequent pickling step.

2 Claims, 5 Drawing Figures

FURNACE FOR THE HEAT TREATMENT OF SCALE-COVERED STEEL

This is a Rule 60 Divisional of Ser. No. 272,118, filed June 10, 1981.

BACKGROUND OF THE INVENTION

The present invention relates to a method and furnace for the heat treatment of a scale-covered steel product.

It is generally known that most metals tend to be incrusted with scales under the influence of heat and ambient atmosphere in refinement or any other processing. The scales so formed are generally membranous outgrowths of the skin and are generally called "mill scales" when formed on hot-rolled metallic products. It is also well known that, under the influence of rain and/or ambient atmosphere, rust tends to develop on the hot-rolled metallic product where some scales have been peeled off because of rough handling of the product.

In view of the above, it is a conventional practice to heat a hot-rolled metallic product for improving the workability and also to remove the scales from the hot-rolled metallic product, prior to the third process being worked thereon. According to the prior art, as shown in FIG. 1 of the accompanying drawings, a steel product, for example, a hoop, wire or rod, is pickled with either sulfuric acid or hydrochloric acid to remove mill scales therefrom during a first pickling step 1. The steel product so treated is subsequently heat-treated in a second step 2 under a reducing atmosphere. During the second heat treatment step 2, the steel product is heated to an appropriate temperature of 650° C. or higher depending on the type of the product, for a predetermined period of time and is then slowly cooled to a temperature of 650° to 500° C., the steel product being thereafter allowed to stand in the atmosphere after it has been cooled to the temperature range, as shown in FIG. 2 of the accompanying drawings which illustrates a heat cycle effected on the product during the heat treatment step 2.

The steel product so heat-treated tends to be incrusted with scales in contact with oxidizing elements in the air while it is allowed to stand subsequent to the heat treatment step 2. Therefore, the steel product with scales thereon is again pickled during the second pickling step 3 to remove the scales completely, i.e., to remove the scales including not only those formed subsequent to the heat treatment step 2, but also those left unremoved during the first pickling step 1.

Since the prior art method described above requires the pickling operation to be performed two times, i.e., before and after the heat treatment, not only is it time-consuming and uneconomical, but also the acid used during each pickling operation may dissolve the work being processed to such an extent as to result in the reduced quality of the steel product.

SUMMARY OF THE INVENTION

We have found that, when the work which has been heat-treated in a reducing atmosphere effective to avoid any possible decarburization without being pickled preparatory to the heat treatment is heated, and is retained in a heated state in an oxidizing atmosphere at a predetermined temperature for a predetermined period of time, the scales on the work which have been reduced during the heat treatment under the reducing atmosphere are re-oxidized and that, when the work is allowed to stand in the atmosphere so as to cause it to cool quickly subsequent to the heat treatment under the oxidizing atmosphere, the scales on the work exhibit fine cracks sufficient to make them so fragile that the subsequent pickling can readily be performed to remove such scales from the work.

The present invention is based on the above described finding and has as its essential object to provide a capability of ready and simplified removal of scales from the work without the employment of the preliminary pickling step which has heretofore been performed preparatory to the heat treatment under the reducing atmosphere.

The above described object of the present invention can be accomplished by providing a method and an apparatus for the heat treatment of a scale-covered, hot-rolled steel work, wherein after the work has been subjected to a heat treatment under a reducing atmosphere in such a way as to heat it to a predetermined temperature for a predetermined period of time and then to allow the heated work to cool slowly down to a predetermined temperature, the work is further heat-treated under an oxidizing atmosphere to cause the scales, which have been reduced during the heat treatment under the reducing atmosphere, to be re-oxidized and the work is then allowed to stand in the atmosphere so as to cool quickly, thereby imparting fine cracks in the scales.

According to the present invention, only a single pickling process is required subsequent to the heat treatment under the oxidizing atmosphere to remove the scales substantially completely without the skin being substantially chapped.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE EMBODIMENTS

Figure 1:
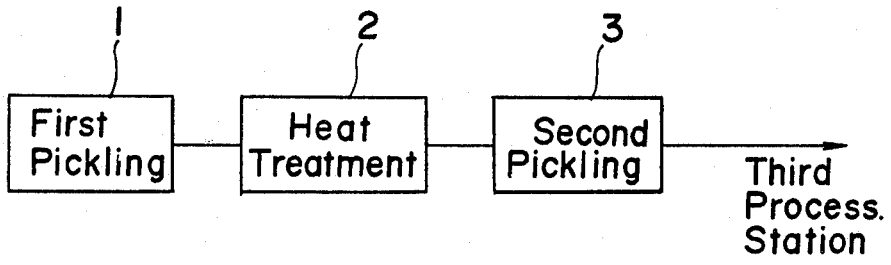
Fig. 1 Prior Art
FIG. 1 is a schematic flow chart of the conventional method for the heat treatment of the scale-covered, hot-rolled steel work.

Before the description of the present invention proceeds, it is to be noted that like parts are designated by like reference numerals throughout the accompanying drawings.

Figure 3:
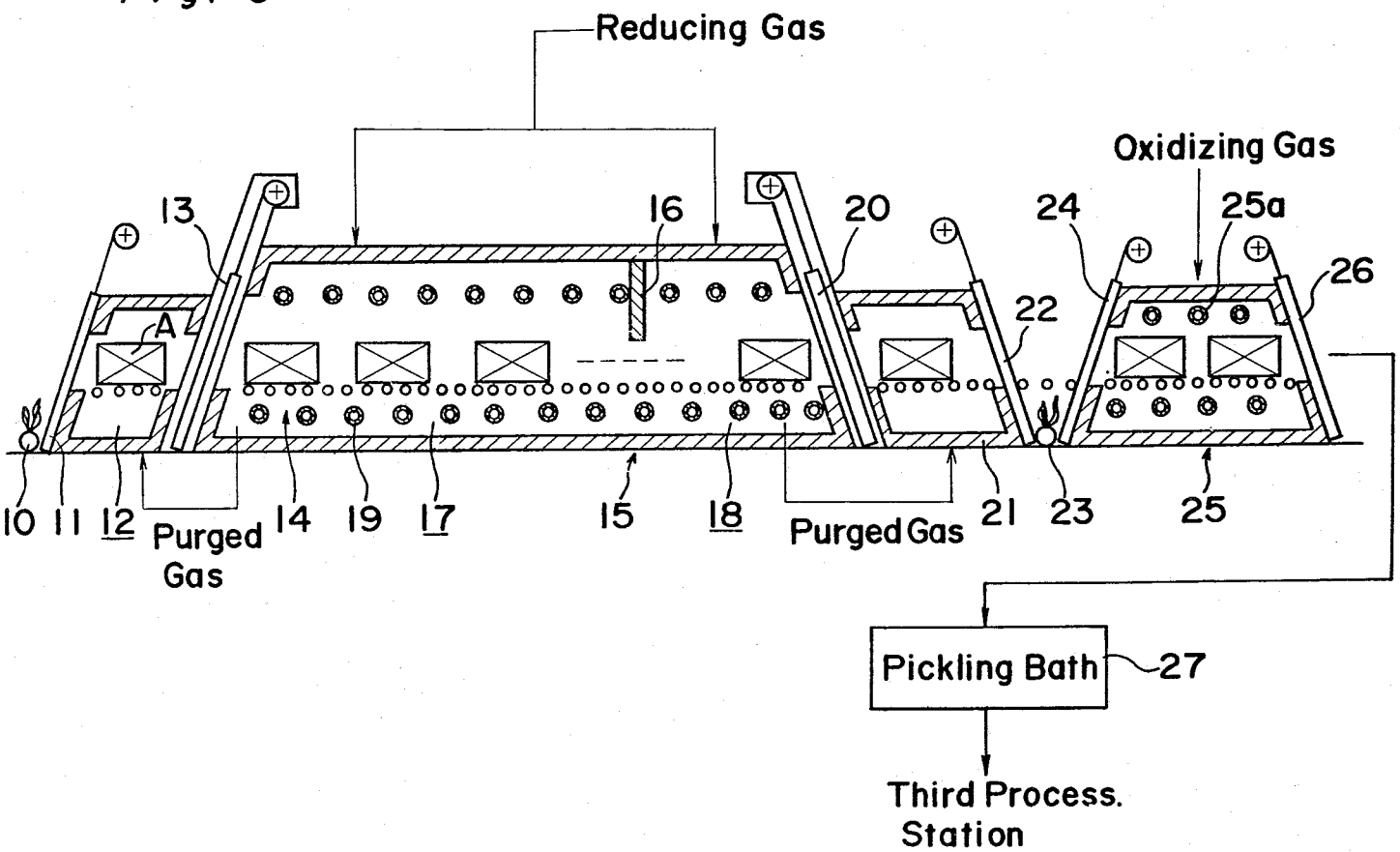
FIG. 3 is a schematic longitudinal sectional view showing a heat-treating furnace according to a preferred embodiment of the present invention.

Referring first to FIG. 3, a hot-rolled work A transported from a hot milling station in the form as incrusted with scales and rust thereon is directly transported into a heat-treating furnace 15 by means of a suitable conveyance 14 past a curtain burner 10, a charge door 11, a charge vestibule 12 and a first partition door 13.

The heat-treating furnace 15 is divided by a drop arch 16 into a heating zone 17 and a slow cooling zone 18 into which a reducing gas, which may be either a mixture of inert gas and endothermic gas, endothermic gas or a mixture of exothermic gas and endothermic gas depending on the material of the work to be heat-treated, is introduced. The heat-treating furnace 15 is equipped with upper and lower rows of radiant tubes 19 arranged within the heating zone 17 above and below the plane along which the work A is transported through the furnace 15, which radiant tubes 19 are operable to generate radiant heat necessary to heat the work A to a predetermined temperature within the range of 650° to 770° C. for a predetermined period of time within the range of 2 to 6 hours under the reducing atmosphere, as shown in the heat cycle chart of FIG. 4, while regulating the decarburization of the work within a permissible value. It is to be noted that the predetermined temperature and the predetermined period of time, both referred to above, are determined in consideration of the type of the work to be heat-treated according to the present invention. It is also to be noted that, when and after the work A has been heated to the predetermined temperature, the work is maintained in a heated state at such predetermined temperature as can readily be understood from the chart of FIG. 4.

The work A so heated within the heating zone 17 is transported by the conveyance 14 into the slow cooling zone 18 whereat the work A is allowed to cool slowly at a predetermined cooling speed within the range of 10° to 20° C./hr, the work being subsequently transported onto a discharge vestibule 21 past a second partition door 20. It is to be noted that part of the reducing gas in the heating zone 17 and slow cooling zone 18 is introduced into the charge vestibule 12 and discharge vestibule 21, respectively, as purge gas.

The work so transported into the discharge vestibule 21 is further transported by the conveyance 14 out of the heat-treating furnace 15 and then into an auxiliary heating furnace 25 past a curtain burner 23 and then past a charge door 24.

The auxiliary heating furnace 25 is filled with an slightly oxidizing atmosphere gas or a weakly oxidizing atmosphere gas depending on the type of the work and is equipped with upper and lower rows of radiant tubes 25*a* which constitute a heating unit and which may be similar to the radiant tubes 19 within the heating furnace 15.

Figure 4:
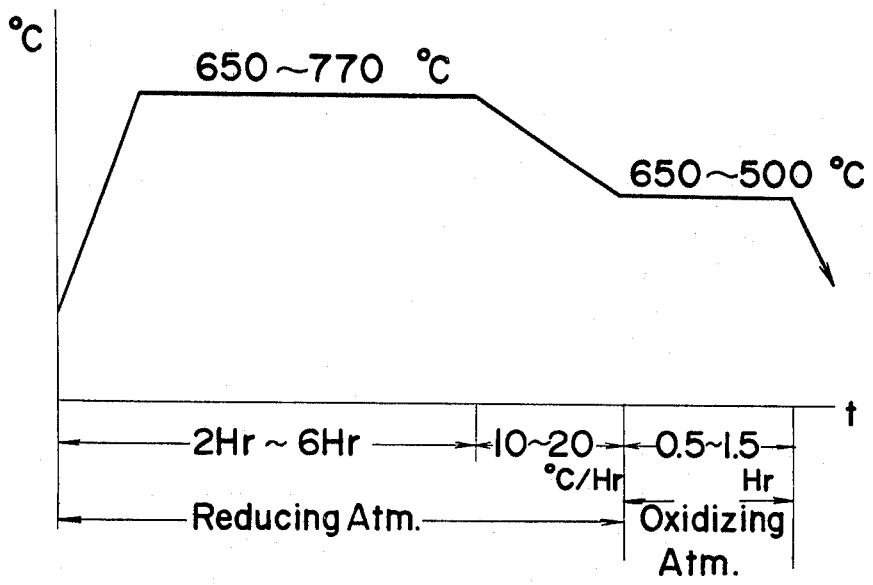
FIG. 4 is a chart showing a heat cycle used in the practice of the present invention.

The work A so transported into the auxiliary heating furnace 25 is kept in a heated state at a predetermined temperature within the range of 650° to 500° C. for a predetermined period of time within the range of 0.5 to 1.5 hours, as shown in the chart of FIG. 4, in an oxidizing atmosphere while heated by the radiant heat emanating from the radiant tubes 25*a*. During this period, the mill scales on the work which have been reduced are re-oxidized.

However, when the work A which has been heated in the auxiliary heating furnace 25 for the predetermined period of time at the predetermined temperature is transported out of the furnace 25 and is then allowed to stand to cool quickly in the atmosphere, the mill scales restored to the original scales by the re-oxidization are imparted with fine cracks sufficient to make the scales easy to be peeled off. Subsequent to the quenching in the atmosphere, the work A is transported to a pickling station 27 whereat the work is immersed into a pickling bath filled with either hydrochloric acid or sulfuric acid to remove the scales from the work.

During the pickling step subsequent to the heat treatment in the furnace 25, since the mill scales on the work A have already been cracked, the pickling to remove the scales and rust from the work can readily and assuredly be performed.

Subsequent to the pickling step, the work is transported to a third processing station as is the case with the conventional practice.

The present invention will now be described by way of example.

A sample, which was a bundle of 10 medium carbon steel rods (Carbon Content: 0.45%), $6\phi \times 150l$, was treated in the following manner to remove scales and rust from the sample.

Within the heat-treating furnace 15 filled with the reducing atmosphere, the sample was first heated for about 6 hours at about 730° C. and was subsequently slowly cooled down to about 650° C. in about 4 hours. After this heat treatment within the furnace 15, the sample was loaded into the furnace 25 filled with the oxidizing atmosphere and was maintained in a heated state for about 1.5 hours at a temperature within the range of about 650° to 550° C. Thereafter, the sample having been removed from furnace 25 was allowed to stand in the atmosphere to cause it to cool quickly and was then immersed for 10 minutes in a pickling bath containing 12% HCl of about 40° C. The result has shown that both the mill scales and the rust were completely removed from the sample with no decarburization found.

Figure 2:
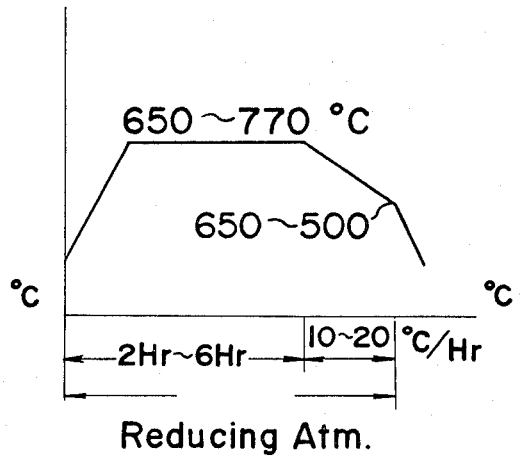
Fig. 2 Prior Art
FIG. 2 is a chart showing the heat cycle used in the conventional method.

For comparison, the same sample as hereinabove described was heat-treated in the conventional furnace according to the heat cycle of FIG. 2 without being pickled prior to such heat treatment and was then pickled for 10 minutes in the pickling bath containing 12% HCl at about 40° C. The result has shown that the mill scales and rust remained unremoved.

Figure 5:
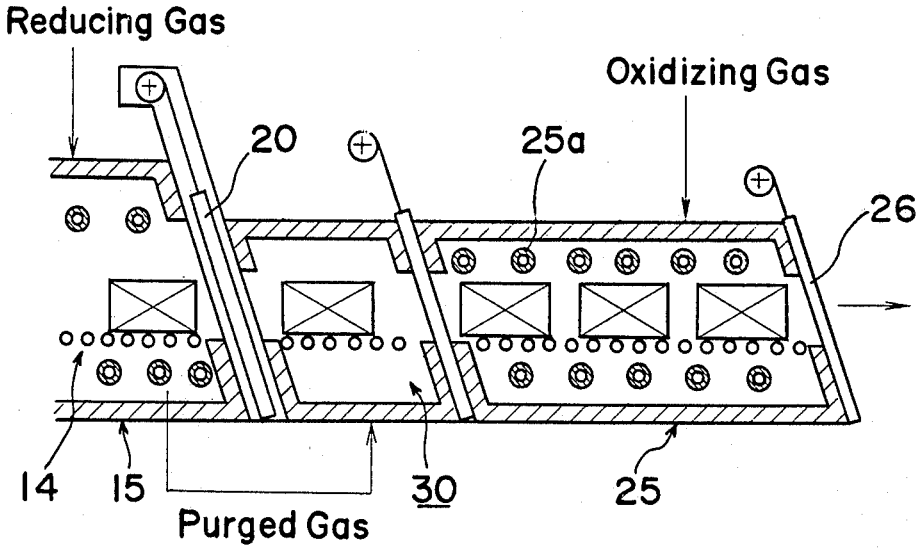
FIG. 5 is a view similar to FIG. 3, showing only a portion of the furnace according to another preferred embodiment of the present invention.

In the embodiment shown in FIG. 5, although the furnaces 15 and 25 have been described and shown as separated from each other in the foregoing embodiment of FIG. 3, they are shown as an integral unit. Specifically, as shown in FIG. 5, the furnace 25 is integrally connected to the furnace 15 through a purge chamber 30 connected to the furnace 15 through the second partition door 20.

From the foregoing, it has now become clear that, since the present invention does not require the employment of the first pickling step such as required in the prior art, not only can the cost of necessary equipment be minimized, but also any possible roughening and/or dissolution of the skin of the work which would result in when pickled so frequently can be minimized.

Furthermore, the method of the present invention can readily be practiced by the use of the furnace structure which may comprise either a combination of primary and auxiliary furnaces or a single furnace integral, which furnace structure is simple in construction according to the present invention.

Although the present invention has fully been described in connection with the preferred embodiments thereof, it should be noted that various changes and modifications are apparent to those skilled in the art. For example, although a heating unit for the auxiliary furnace has been described as constituted by the radiant tubes, it may be constituted by an electric resistance heater.

Moreover, instead of the employment of the radiant tubes or electric resistance heater in the auxiliary furnace, either a direct firing burner or an exhaust gas emitted from the furnace 15, i.e., an exhaust gas from the radiant tubes inside the furnace 15 where the heating unit in the furnace 15 is employed in the form of the radiant tubes may be employed, noting that, where the exhaust gas is employed for heating, it should be supplied from the furnace 15 into the auxiliary furnace 25. This is possible because the exhaust gas from the radiant tubes and a combustion gas emitted from the direct firing burner are both oxidizing. In this case, the supply of the oxidizing gas in the manner as hereinbefore described is not required.

Therefore, such changes and modifications are to be understood as included within the true scope of the present invention unless they depart therefrom.

We claim:

1. An apparatus for heat treating a hot-rolled steel work having scales formed thereon comprising:

a heat treating furnace including a charge vestibule, a heat treating zone and a discharge vestibule;

means for supplying to said heat treating zone a gaseous reducing atmosphere under which the steel work is cooled slowly at a rate of 10° to 20° C. per hour after the steel work has been heated to temperatures in the range of 650° to 770° C.; and a heating furnace provided adjacent to said discharge vestibule of said heat treating furnace, and containing means for maintaining said steel work at temperatures in the range of 500° to 650° C. in an oxidizing atmosphere.

2. An apparatus for heat treatment of a hot-rolled steel work having scales formed thereon, comprising, in combination:

a charge vestibule;

a heat treating zone supplied with a gaseous reducing atmosphere under which the steel work is cooled slowly at a rate of 10° to 20° C. per hour after the steel work has been heated to temperatures in the range of 650° to 770° C.;

a purge chamber; and a heating zone including means for maintaining said steel work at 500° to 650° C. under an oxidizing atmosphere.

* * * * *